US007862198B2

(12) United States Patent
Shyu et al.

(10) Patent No.: US 7,862,198 B2
(45) Date of Patent: Jan. 4, 2011

(54) LIGHTING DEVICE HAVING ENERGY CONVERSION MODULE

(75) Inventors: Ruey-Jong Shyu, Taoyuan Hsien (TW); Kuan-Liang Chen, Taoyuan Hsien (TW); Liang-Jyi Chen, Taoyuan Hsien (TW); Ming-Huei Yang, Taoyuan Hsien (TW)

(73) Assignee: J Touch Corporation, Taoyuan Hsien (TW)

( * ) Notice: Subject to any disclaimer, the term of this patent is extended or adjusted under 35 U.S.C. 154(b) by 325 days.

(21) Appl. No.: 12/232,700

(22) Filed: Sep. 23, 2008

(65) Prior Publication Data

US 2009/0196039 A1 Aug. 6, 2009

(30) Foreign Application Priority Data

Feb. 1, 2008 (TW) ..... 97103906 A

(51) Int. Cl.
*F21L 13/00* (2006.01)

(52) U.S. Cl. ..... 362/192; 362/341; 362/217.02; 362/343

(58) Field of Classification Search ..... 362/217.02, 362/217.05, 341, 343, 192, 183; 136/244, 136/252

See application file for complete search history.

(56) References Cited

U.S. PATENT DOCUMENTS

| | | | | | |
|---|---|---|---|---|---|
| 3,061,731 | A * | 10/1962 | Thier et al. | ..... | 250/559.42 |
| 4,759,735 | A * | 7/1988 | Pagnol et al. | ..... | 441/16 |
| 4,972,255 | A * | 11/1990 | Suzuki et al. | ..... | 358/513 |
| 5,716,442 | A * | 2/1998 | Fertig | ..... | 136/246 |
| 6,730,840 | B2 * | 5/2004 | Sasaoka et al. | ..... | 136/246 |
| 7,057,821 | B2 * | 6/2006 | Zincone | ..... | 359/595 |
| 2004/0104304 | A1 * | 6/2004 | Parmley | ..... | 244/30 |
| 2007/0091283 | A1 * | 4/2007 | Chen | ..... | 353/99 |

FOREIGN PATENT DOCUMENTS

JP 07210306 * 8/1995

* cited by examiner

*Primary Examiner*—Ali Alavi
(74) *Attorney, Agent, or Firm*—Bacon & Thomas, PLLC

(57) ABSTRACT

The present invention provides a lighting device having an energy conversion module, comprising a lamp and at least one energy conversion module. The lamp includes a shade and a lamp tube. The lamp tube is disposed beneath the shade, and the inner wall surface of the shade can reflect light from the lamp tube. The energy conversion module is configured inside the shade or disposed on a lamp grid to receive light energy and convert it into electrical energy. As such, the lighting device can give light to photovoltaic cells in the environment so that electrical energy is generated. The object of converting part of the light energy into electrical energy for further utilization can thus be achieved.

21 Claims, 7 Drawing Sheets

LIGHTING DEVICE HAVING ENERGY CONVERSION MODULE

BACKGROUND OF THE INVENTION

1. Field of the Invention

The present invention relates to a lighting device having an energy conversion module, and more particularly, to a lighting device equipped with an energy conversion module that receives light energy from a variety of commonly used lamps, such as fluorescent lamps, and converts the light energy into electrical energy.

2. Description of the Related Art

The use of lighting devices is universally prevalent. Along with the progression of time, the technology of lamps also evolves, from the use of incandescent light bulbs to fluorescent tubes and to white light-emitting diodes (LEDs) nowadays. The evolution is not only about new lamp styles, but also about improvements in illumination efficiency. Fluorescent lamps are one type of lighting devices commonly used; usually, there is a reflection layer coated on the metal support, e.g., the shade, of the fluorescent tube for enhancing the illumination effect (illuminance) and improving energy efficiency. Conventional lighting devices are used typically for illumination only. How to make further use of light sources to enhance energy utilization efficiency is a meaningful task.

A photovoltaic cell absorbs light energy to generate electricity. For instance, silicon-based solar cells absorb sunlight to produce electricity. But such solar cells are not efficient in absorbing light energy generated by indoor lighting devices. By contrast, dye-sensitized solar cells can absorb both indoor and outdoor light, including sunlight and light from lighting devices, and exhibit better energy conversion efficiency. A dye-sensitized solar cell (DSSC) converts light energy into electrical energy by a photoelectrochemical energy conversion mechanism. Its operation principle is different from that of a silicon crystal solar cell or a thin film solar cell which uses silicon as material. A DSSC generally consists of two pieces of transparent conducting oxide (TCO) glasses: one TCO glass is an electrode on which semiconductor oxide material such as nanocrystalline titanium oxide ($TiO_2$) layer is deposited; the other is a counterelectrode which has platinum thin film on it. In between two electrodes, there are electrolyte and dye molecules adsorbed in $TiO_2$ layer. After the two electrodes are properly packaged and sealed, a DSSC is completed. When sun light irradiates a DSSC, the dye molecules release electrons that pass through the $TiO_2$ layer and TCO layer to an outer circuit for generating electricity. The electrons then go to the counterelectrode, where they undergo the electrocatalytic activity of the platinum and redox reaction of the electrolyte, and return to the dye molecules to complete the cycle. A DSSC absorbs solar energy within the range of visible light spectrum. In addition to absorbing solar radiation in an outdoor environment to generate electricity, a DSSC can also generate electricity at lower light intensity either in an indoor environment or under lighting devices; therefore it can be used in both outdoor and indoor environments. Besides, a DSSC uses more common materials, such as conducting glass, titanium oxide, platinum, electrolyte and dye. Also, manufacturing a DSSC does not require expensive equipments such as PECVD equipment, but requires only inexpensive equipments like screen printers, sintering ovens, etc. Therefore, compared with silicon-based solar cells, DSSCs are advantageous in reducing manufacturing cost. A DSSC can have various colors based on the dyes it uses, and it can also be made on flexible substrates. The DSSC is a new-generation solar cell of multiple applications. In sum, using such dye-sensitized solar cell to absorb light energy and convert it into electrical energy for use in other devices can enhance energy utilization efficiency and facilitate uses of products.

SUMMARY OF THE INVENTION

A primary object of the present invention is to provide an indoor lighting device having an energy conversion module that irradiates a photovoltaic cell, which can thus generate electrical energy for further application.

Another object of the present invention is to provide a lighting device having an energy conversion module that can supply electricity to electrical appliances or to rechargeable batteries. The energy conversion module comprises a photovoltaic cell and a power output unit so that through the module, light energy can be converted into electrical power output. The photovoltaic cell may include silicon-based solar cell, thin-film solar cell, or dye-sensitized solar cell. And the circuit module of the power output unit comprises a boost circuit to boost the power.

To achieve the aforesaid objects, the lighting device having an energy conversion module of the invention comprises a lamp and at least one energy conversion module, the lamp comprising a shade and a lamp tube, the lamp tube being disposed beneath the shade. The inner wall surface of the shade is able to reflect light from the lamp tube. The energy conversion module is disposed on the inner wall surface of the shade to receive light from the lamp tube and convert the light energy into electrical energy. The reflective surface of the shade has a first wall surface, a third wall surface, and a second wall surface connected to the first and the third wall surfaces respectively. The energy conversion module is disposed on the second wall surface, on the first wall surface, or on the third wall surface. Furthermore, the width of the energy conversion module is equal to or less than the diameter of the lamp tube.

In another embodiment of the invention, the lighting device having an energy conversion module comprises a lamp and at least one energy conversion module, the lamp comprising a shade, a lamp grid, and a lamp tube. The shade and the lamp grid are adjoined together such that the lamp tube is situated inside the shade and the lamp grid, and the inner wall surfaces of both the shade and the lamp grid can reflect light from the lamp tube. The lamp grid comprises a longitudinal rib and a horizontal rib. The energy conversion module is disposed on the longitudinal rib or on the horizontal rib of the lamp grid wall to receive light from the lamp tube and convert the light energy into electrical energy.

In yet another embodiment of the invention, the lighting device having an energy conversion module comprises a lamp having a base, a shade and a light source set, the light source set being situated inside the shade, and the light source set and the shade being disposed on the base; an LED assembly disposed at the periphery of the lighting device; and an energy conversion module disposed on the base to receive light from the light source set, convert the light energy into electrical energy, and supply it to the LED assembly. The light source set comprises a mount and a light source, the light source being electrically connected to the mount. The light source is a light bulb, lamp tube, LED light or fluorescent light.

In the present invention, the photovoltaic cell can be disposed at a proper location between the lamp tube and the shade, on the longitudinal rib or horizontal rib of the lamp grid wall, or on the lamp base to fully utilize the source of illumination and enhance energy utilization efficiency. Hence, this invention is a novel invention.

DETAILED DESCRIPTION OF THE INVENTION

Figure 1:
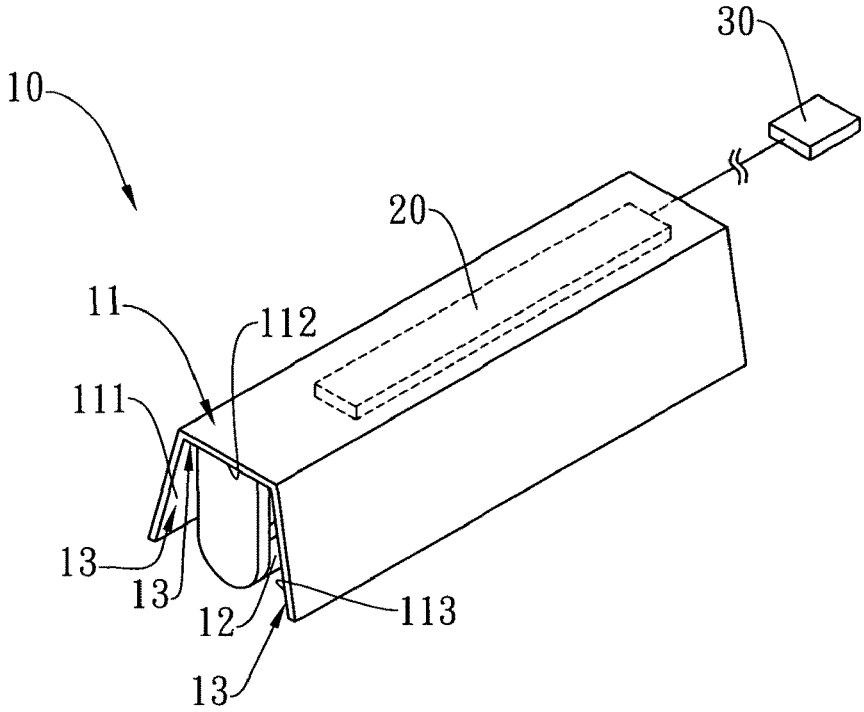
FIG. 1 is an exploded schematic view of a dye-sensitized solar cell for use with a lighting device having an energy conversion module according to the invention.

The present invention is to provide an indoor lighting device having an energy conversion module. The energy conversion module of the invention is an assembly of a photovoltaic cell and a power output unit. The photovoltaic cell is a solar cell, which may include silicon-based solar cell, thin-film solar cell, dye-sensitized solar cell and other types of solar cell with equivalent effect. FIG. 1 illustrates a dye-sensitized solar cell used in an embodiment of the present invention. The dye-sensitized solar cell comprises a first electrode 100, a second electrode 200, and a nano-layer 300 sandwiched between them. The first electrode 100 comprises a first conductive glass layer 101 and a platinum catalyst layer 102. The first conductive glass layer 101 comprises a first glass layer 103 and a first transparent conductive oxide thin film 104 such that the platinum catalyst layer 102 is adhered to the surface of the first transparent conductive oxide thin film 104. The second electrode 200 comprises a second conductive glass layer 201 having a second glass layer 202 and a second transparent conductive oxide 203. The nano-layer 300 includes a oxide-semiconductor thin film 301, a plurality of dye molecules adsorbed thereto, and an electrolyte 303. Thus, when the dye-sensitized solar cell receives light energy, it will emit electrons, which are transmitted to external lines via the oxide-semiconductor thin film and the conductive glass layer for supplying electricity.

Figure 2:
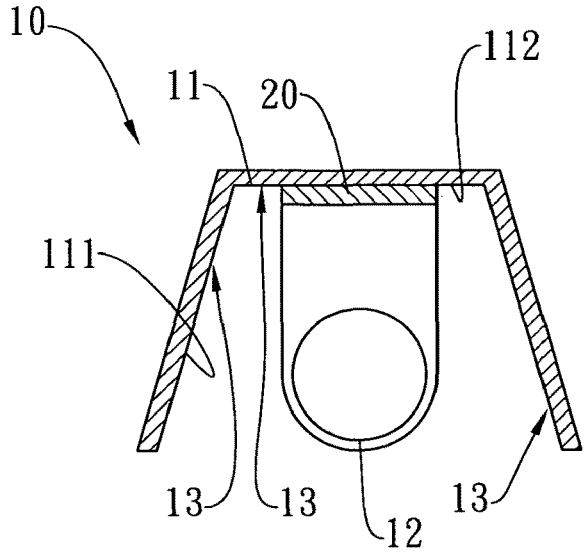
FIG. 2 is a schematic view of the power output unit of a lighting device having an energy conversion module according to the invention.

As shown in FIG. 2, the power output unit 400 of the invention enables the energy conversion module 20 to supply electricity. The circuit module of the power output unit 400 includes a boost circuit 401 to boost the voltage before output. The power output of the invention can supply electricity to a rechargeable battery or an electrical appliance, such as an LED unit, a lamp unit, a decorative unit with light source, or any equivalent unit.

Figure 3:
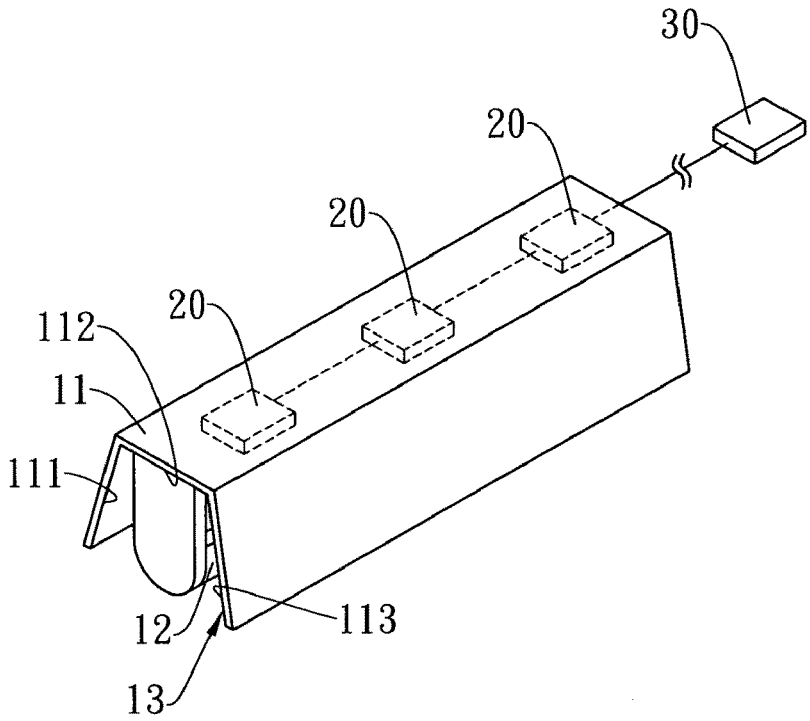
FIG. 3 is a perspective view of the lighting device having an energy conversion module according to a first embodiment of the invention.
Figure 4:
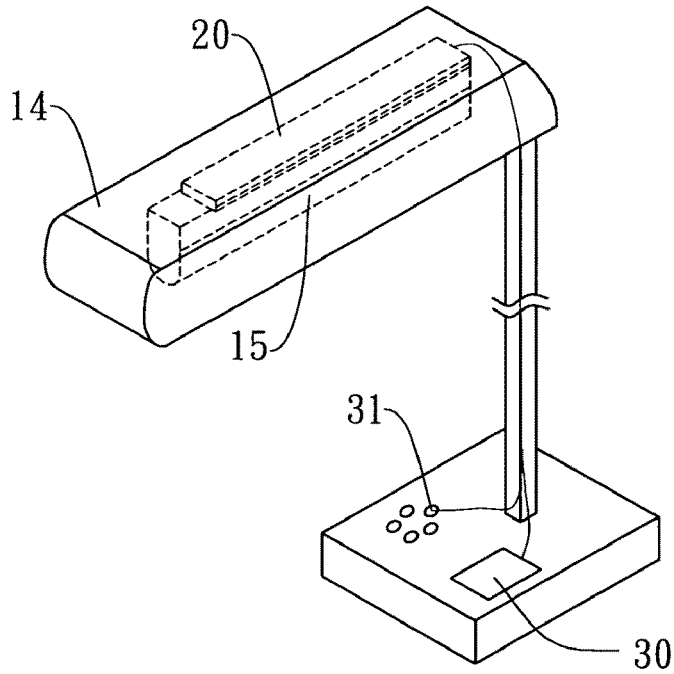
FIG. 4 is a sectional view of the lighting device having an energy conversion module according to the first embodiment of the invention.
Figure 5:
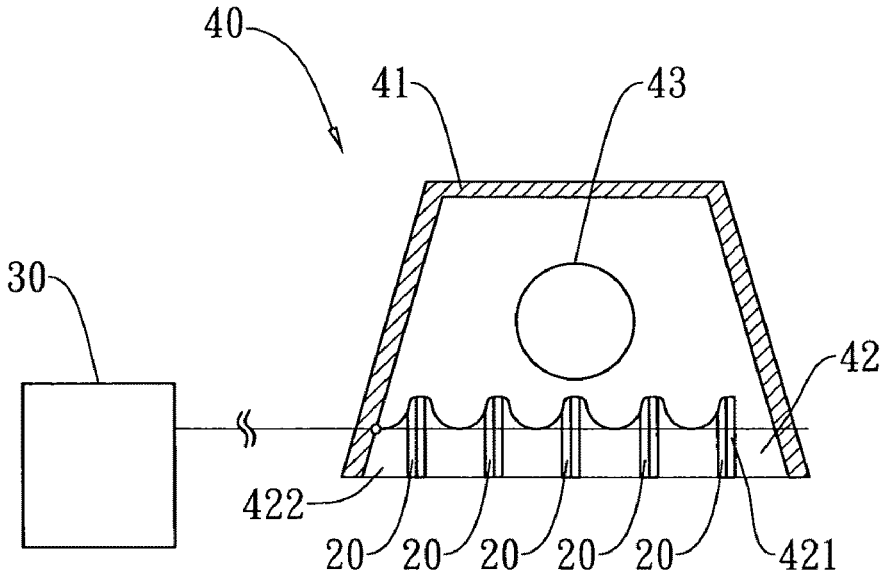
FIG. 5 is a layout view of a plurality of energy conversion modules on a lighting device according to the invention.

FIG. 3, FIG. 4 and FIG. 5 are respectively a perspective view, a sectional view, and a layout view of a plurality of energy conversion modules according to the first embodiment of the invention. As shown in FIG. 1 and FIG. 2, the lighting device of the invention comprises a lamp 10 and at least one energy conversion module 20 mounted therein. The lamp 10 comprises a shade 11 and a lamp tube 12, which is disposed beneath or inside the shade 11. In order to reflect light for enhancing illuminance, a reflective surface 13 is provided on the inner wall surface of shade 11 to reflect light emitted from the lamp tube 12. The energy conversion module 20 is disposed inside the shade 11. In this embodiment, the energy conversion module 20 is disposed on the inner wall surface of the shade 11 to receive light emitted from the lamp tube 12 and convert the light energy into electrical energy. The inner wall surface of the shade 11 has a first wall surface 111, a third wall surface 113, and a second wall surface 112 connected respectively to the first wall surface 111 and the third wall surface 113. The first wall surface 111 and the third wall surface 113 are not on the same plane as the second wall surface 112. The first wall surface 111 and the second wall surface 112 are obtuse angled, and the third wall surface 113 and the second wall surface 112 are obtuse angled as well. The energy conversion module 20 is disposed on the second wall surface 112, on the third wall surface 113, or on the first wall surface 111. The energy conversion module 20 can also be situated at both ends, or at either end, of the second wall surface 112. In this embodiment, the width of the energy conversion module 20 is equal to or less than the diameter of the lamp tube 12 so as to avoid reducing the overall illuminance and to convert part of the light energy into electrical energy as well.

As shown in FIG. 5, one or a plurality of energy conversion modules 20 are arranged at any location on the inner wall surface, including the first wall surface 111, the second wall surface 112, and the third wall surface 113, of the shade 11. If a plurality of energy conversion modules 20 are to be arranged for the lamp, they must be electrically interconnected in order to supply power to a rechargeable battery or to an electrical appliance 30.

Figure 6:
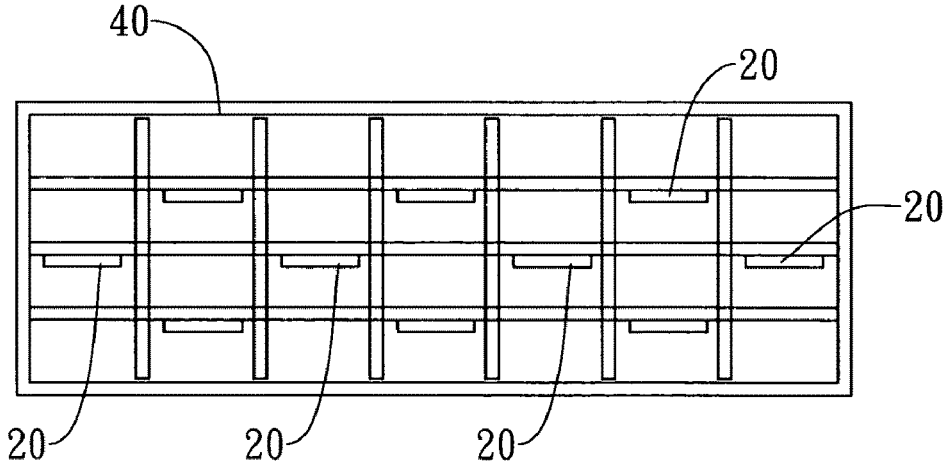
FIG. 6 is a perspective view of a lighting device having an energy conversion module according to a second embodiment of the invention.

FIG. 6 is a perspective view of a lighting device having an energy conversion module according to the second embodiment of the invention. The embodiment shows a table lamp where the energy conversion module 20 is disposed on the inner wall surface of the shade 14 and situated above the lamp tube 15, and the width of the energy conversion module 20 is equal to or less than the diameter of the lamp tube 15. The energy conversion module 20 is electrically connected to the charger inside the lamp base, or to an LED unit 31. If a charger is provided at the lamp base, the charger can be connected further to a handheld device, e.g. mobile phone, for charging it. Additionally, a rechargeable battery may be arranged inside the lamp base, storing electricity coming from the power output. The rechargeable battery can then supply power to a charger if applicable. Naturally, chargers of various specifications in accordance with different handheld devices can be provided for the lamp base.

Figure 7:
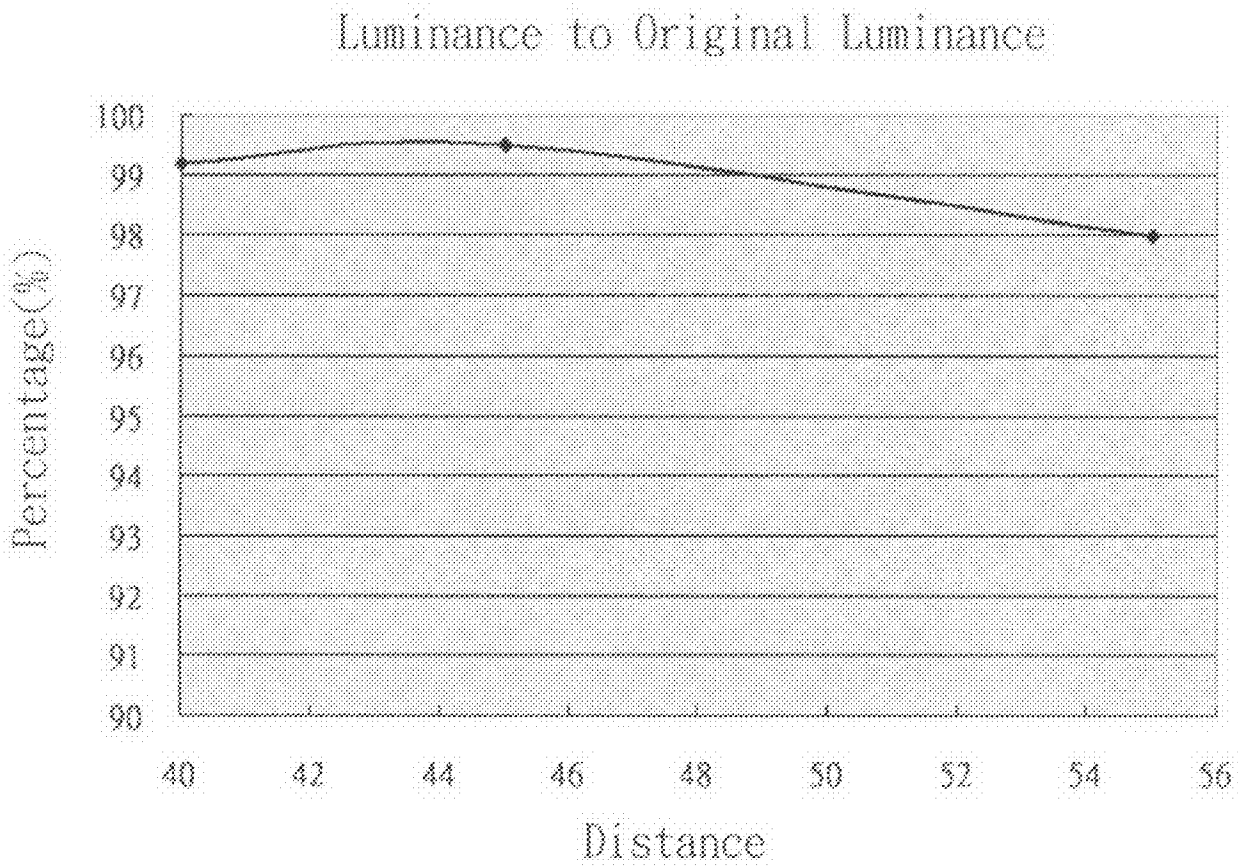
FIG. 7 is a sectional view of a lighting device having an energy conversion module according to a third embodiment of the invention.
Figure 8:
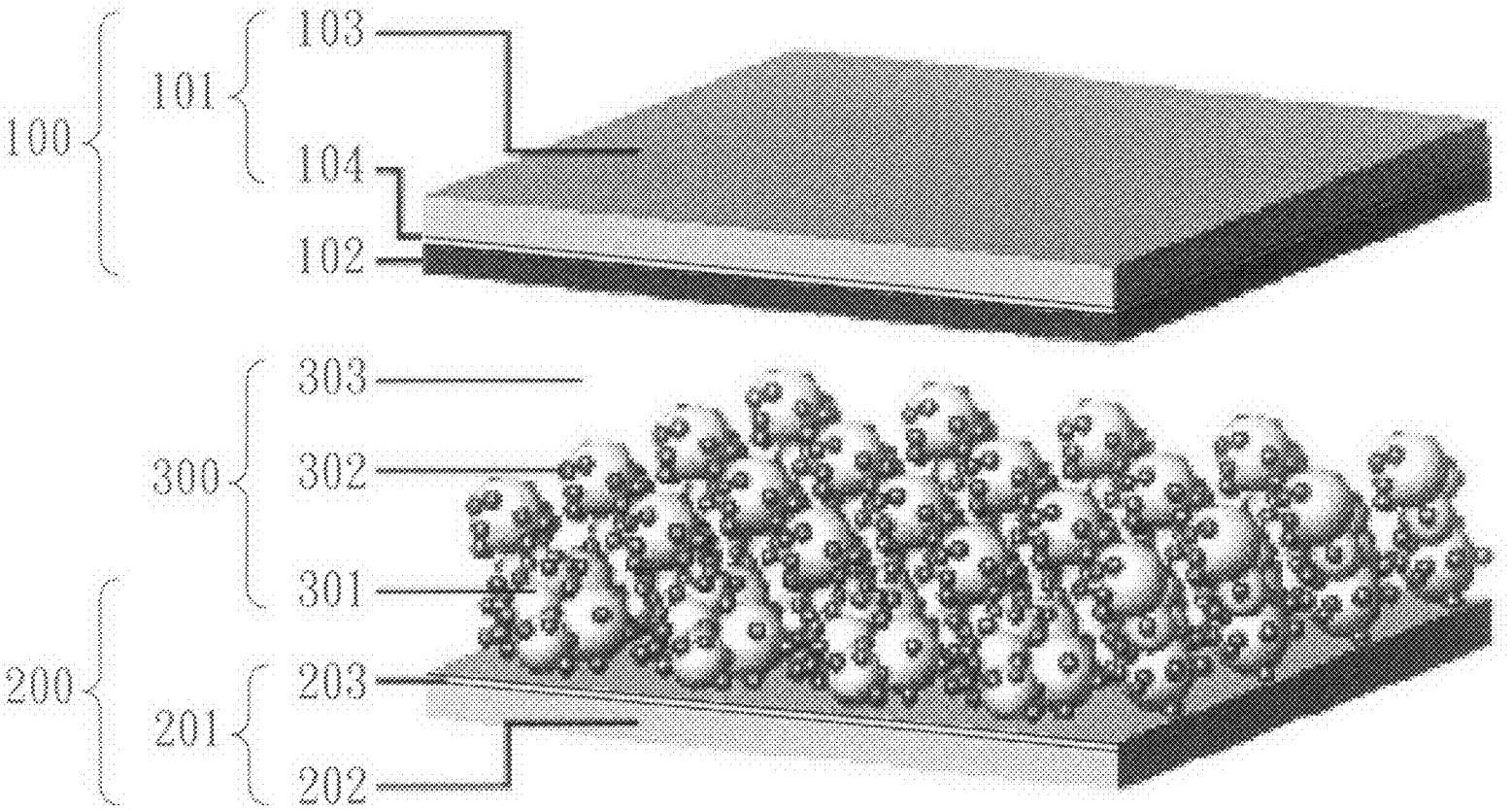
FIG. 8 is a top view of the lighting device having an energy conversion module according to the third embodiment of the invention.

FIG. 7 and FIG. 8 are respectively a sectional view and a top view of a lighting device having an energy conversion module according to the third embodiment of the invention. As shown, the lighting device comprises a lamp 40 and at least one energy conversion module 20. The lamp 40 comprises a shade 41, a lamp grid 42, and a lamp tube 43. The shade 41 and the lamp grid 42 are adjoined together such that the lamp tube 43 is situated between the shade 41 and the lamp grid 42, wherein the lamp grid 42 and the wall surfaces of the shade 41 can reflect light from the lamp tube 43. The lamp grid 42 has a longitudinal rib 421 and a horizontal rib 422. The energy conversion module 20 is disposed at the longitudinal rib 421 or at the horizontal rib 422 to receive light from the lamp tube 43 and convert the light energy into electrical energy. Moreover, the longitudinal rib 421 or the horizontal rib 422 of the lamp grid 42 may be replaced by the energy conversion module 20, that is, a dye-sensitized solar cell can be used as the longitudinal rib 421 or as the horizontal rib 422. As such, when the energy conversion module 20 is irradiated by light, electricity is generated that can be supplied to various kinds of electrical appliances or chargers. The energy conversion module 20 includes a dye-sensitized solar cell.

FIG. 7 shows a plurality of energy conversion modules 20 electrically interconnected that supply electricity to a rechargeable battery or to an electrical appliance 30.

As shown in FIG. 8, the longitudinal ribs 421 and the horizontal ribs 422 of the lamp grid are vertically connected. In this embodiment of the invention, the energy conversion modules 20 are mounted on certain area of the longitudinal ribs 421 and 422. As described above, the longitudinal ribs 421 and 422 can be directly replaced by the energy conversion modules 20, which will absorb some part of the light, convert it into electricity, and supply the electricity to appliances.

A silicon-based solar cell or a dye-sensitized solar cell can be used in the present invention. Table 1 shows the power generated at different illuminance.

TABLE 1

| Cell type | Dye-sensitized solar cell (10 cm × 10 cm) | Single crystal silicon solar cell (10 cm × 10 cm) |
|---|---|---|
| Illuminance (lux) | 20700 | 21600 |
| Max. power (mW) | 33.7 | 33.9 |

Note:
Measured under a tri-wavelength fluorescent tube

Figure 9:
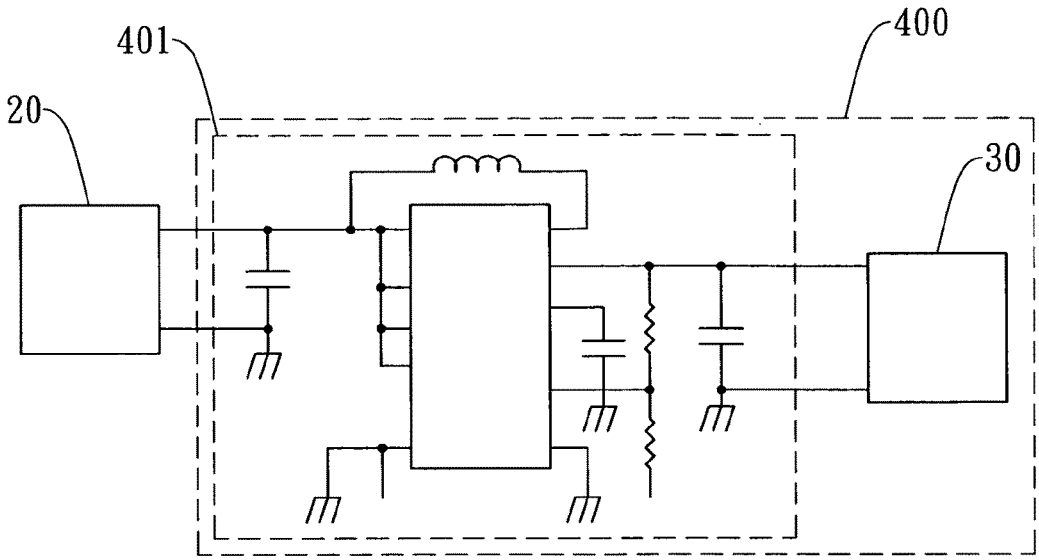
FIG. 9 is a percentage chart illustrating the illuminance of a lighting device according to this invention vs. original illuminance (i.e., illuminance measured when no solar cells are installed)

In one experiment example, three 3.5 cm×4.7 cm dye-sensitized solar cells were used, which could produce a current of 20-50 mA and a voltage of 0.6-2.1V. These solar cells were installed inside the shade of the fluorescent lamp and situated right above the lamp tube. The lamp fixture was a dual-tube one, FV-H2277-H made by China Electric MFG. In this embodiment, only one lamp tube, a tri-wavelength tube TLC 18W/865 of Philips, was used. The illuminance range of the lamp was 600-1230 lux. The illuminance meter was placed about 40-60 cm below the lamp tube. The experiment found that when three dye-sensitized solar cells were used, the percentage of illuminance to original illuminance (intensity measured without solar cells) was 98-99.2% as shown in FIG. 9.

Figure 10:
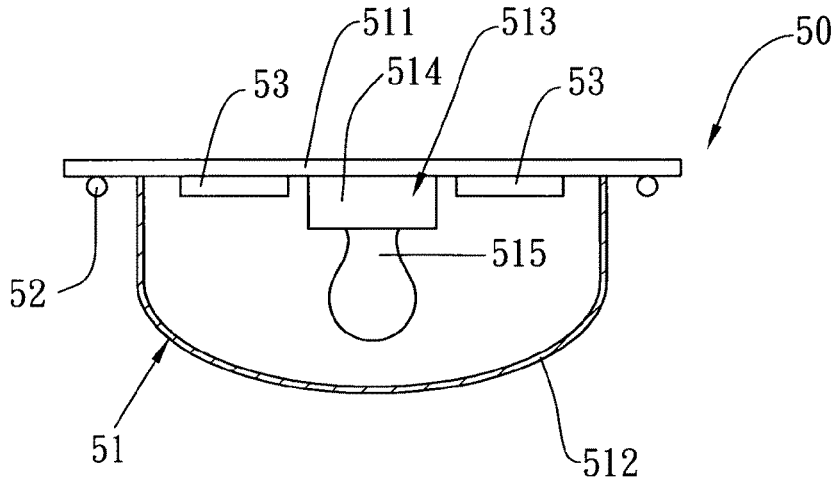
FIG. 10 is a sectional view of a lighting device having an energy conversion module according to a fourth embodiment of the invention.
Figure 11:
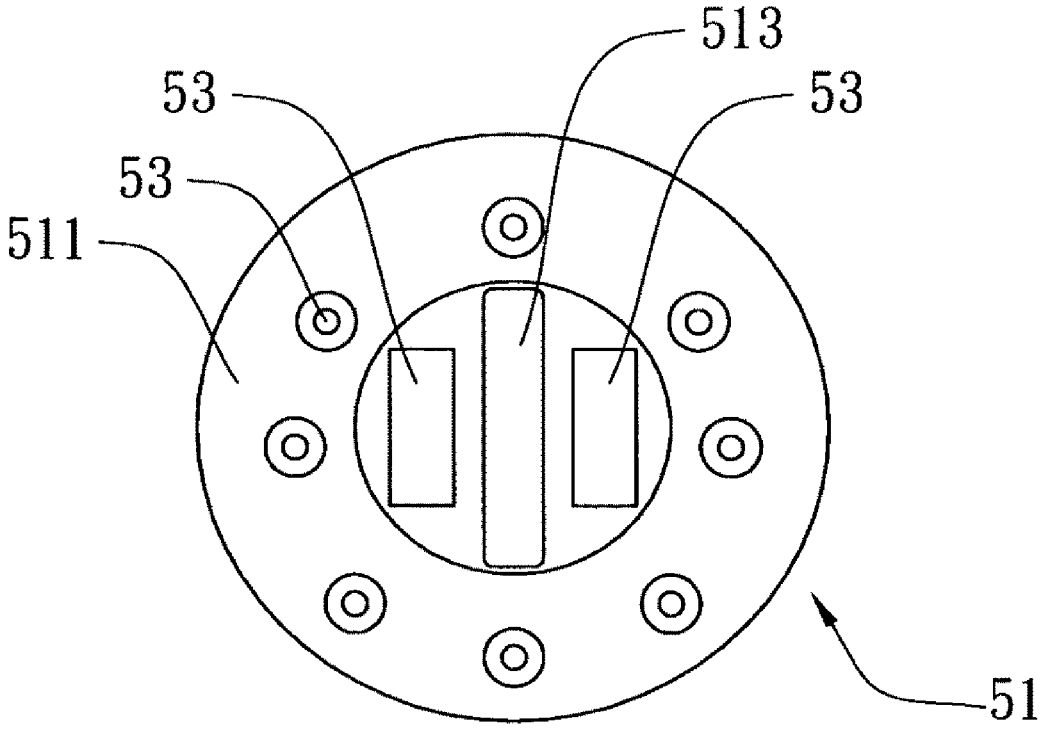
FIG. 11 is a top view of a lighting device having an energy conversion module according to a fourth embodiment of the invention.

FIG. 10 and FIG. 11 are respectively a sectional view and a top view of a lighting device having an energy conversion module according to the fourth embodiment of the invention. In this embodiment, the lighting device comprises a lamp 51 having a base 511, a shade 512 and a light source set 513, the light source set 512 being disposed inside the shade 512, and the light source set 513 and the shade 512 being mounted on the base 511; an LED assembly 52 disposed at the periphery of the lamp 51; and an energy conversion module 53 disposed on the base 511 that receives light from the light source set 513, converts the light energy into electrical energy, and supplies the electrical energy to the LED assembly. The energy conversion module 53 is a photovoltaic cell, such as a silicon-based solar cell, thin-film solar cell, or dye-sensitized solar cell. The energy conversion module 53 comprises a dye-sensitized solar cell and a power output unit enabling the energy conversion module to convert light energy into electricity. The circuit module of the power output unit includes a boost circuit to boost the voltage of power before output. Other components of the lighting device in this embodiment are identical to those described above and will not be elaborated here. The light source set 513 includes a mount 514 and a light source 515, the light source 515 being electrically connected to the mount 514. The light source is a light bulb, lamp tube, LED light or fluorescent tube.

As described above, the present invention uses a lighting device to irradiate photovoltaic cells indoor that enables the photovoltaic cells to produce electrical energy, wherein an energy conversion module disposed on the lighting device can convert part of the light energy into electrical energy. The invention provides improved functions and therefore meets the essential requirements of a patent.

What is claimed is:

1. A lighting device having an energy conversion module, comprising:

a lamp comprising a shade and a lamp tube, the lamp tube being disposed beneath the shade, and the inner wall surface of the shade being able to reflect light from the lamp tube; and at least one energy conversion module disposed inside the shade to receive light energy from the lamp tube and convert it into electrical energy.

2. The lighting device according to claim 1, wherein the inner wall surface of the shade includes a first wall surface, a third wall surface, and a second wall surface connected respectively to the first wall surface and to the third wall surface, and the energy conversion module is disposed on any of the wall surfaces.

3. The lighting device according to claim 1, wherein the width of the energy conversion module is equal to or smaller than the diameter of the lamp tube.

4. The lighting device according to claim 1, wherein the energy conversion module comprises a photovoltaic cell and a power output unit to convert light energy and output electricity.

5. The lighting device according to claim 4, wherein the photovoltaic cell is a solar cell, which is a silicon-based solar cell, a thin-film solar cell, or a dye-sensitized solar cell.

6. The lighting device according to claim 5, wherein the dye-sensitized solar cell comprises a first electrode, a second electrode, and a nano-layer sandwiched therebetween, the first electrode comprising a first conductive glass layer and a platinum catalyst layer wherein the first conductive glass layer comprises a first glass layer and a first transparent conductive oxide thin film, and wherein the platinum catalyst layer is adhered to the surface of the first transparent conductive oxide thin film, the second electrode comprising a second conductive glass layer having a second glass layer and a second transparent conductive oxide thin film, and an oxide photo-semiconductor thin film, a plurality of dye molecules adsorbed thereto, and an electrolyte.

7. The lighting device according to claim 4, wherein the power output unit comprises a boost circuit to boost the voltage of the electricity.

8. The lighting device according to claim 4, wherein the electricity is outputted to an LED unit, a charger, or a decorative light unit with a light source.

9. A lighting device having an energy conversion module, comprising:

a lamp comprising a shade, a lamp grid and a lamp tube, the shade and the lamp grid being adjoined together such that the lamp tube is situated inside the shade and the lamp grid, the inner wall surface of the shade being able to reflect light from the lamp tube, the lamp grid having a longitudinal rib and a horizontal rib; and at least one energy conversion module to receive light energy from the lamp tube and convert it into electrical energy.

10. The lighting device according to claim 9, wherein the energy conversion module comprises a photovoltaic cell and a power output unit to convert light energy and output electricity.

11. The lighting device according to claim 10, wherein the photovoltaic cell is a solar cell, which is a silicon-based solar cell, a thin-film solar cell, or a dye-sensitized solar cell.

12. The lighting device according to claim 10, wherein the power output unit comprises a boost circuit to boost the voltage of the electricity.

13. The lighting device according to claim 12, wherein the electricity is outputted to an LED unit, a charger, or a decorative unit with a light source.

14. The lighting device according to claim 9, wherein the energy conversion module is disposed on the longitudinal rib or on the horizontal rib of the lamp grid wall.

15. The lighting device having according to claim 9, wherein the longitudinal rib or the horizontal rib is an energy conversion module.

16. A lighting device having an energy conversion module, comprising:

a lamp comprising a base, a shade, and a light source set, the light source set being disposed inside the shade, and the light source set and the shade being mounted on the base;

an LED assembly disposed at the periphery of the lamp; and an energy conversion module disposed on the base to receive light energy from the light source set, convert the light energy into electrical energy, and supply the electrical energy to the LED assembly.

17. The lighting device according to claim 16, wherein the energy conversion module comprises a photovoltaic cell and a power output unit to convert light energy and output electricity.

18. The lighting device according to claim 17, wherein the photovoltaic cell is a solar cell, which is a silicon-based solar cell, a thin-film solar cell, or a dye-sensitized solar cell.

19. The lighting device according to claim 18, wherein the power output unit comprises a boost circuit to boost the voltage of the electricity.

20. The lighting device according to claim 16, wherein the light source set comprises a mount and a light source, the light source being electrically connected to the mount.

21. The lighting device according to claim 20, wherein the light source is a light bulb, a lamp tube, an LED light or a fluorescent lamp.

* * * * *